US009702172B2

(12) United States Patent
Su et al.

(10) Patent No.: US 9,702,172 B2
(45) Date of Patent: Jul. 11, 2017

(54) LOCKSET AND REMOVABLE-TYPE PALLET BOX USING LOCKSET

(75) Inventors: Jijun Su, Dalian (CN); Liang Lu, Dalian (CN); Jiansheng Ni, Dalian (CN)

(73) Assignees: CHINA INTERNATIONAL MARINE CONTAINERS (GROUP) LTD., Shenzhen, Guangdong (CN); DALIAN CIMC LOGISTICS EQUIPMENT CO., LTD., Dalian, Liaoning (CN)

( * ) Notice: Subject to any disclaimer, the term of this patent is extended or adjusted under 35 U.S.C. 154(b) by 364 days.

(21) Appl. No.: 14/372,527

(22) PCT Filed: Sep. 3, 2012

(86) PCT No.: PCT/CN2012/080908

§ 371 (c)(1),
(2), (4) Date: Jul. 16, 2014

(87) PCT Pub. No.: WO2013/107183

PCT Pub. Date: Jul. 25, 2013

(65) Prior Publication Data

US 2014/0367289 A1 Dec. 18, 2014

(30) Foreign Application Priority Data

Jan. 17, 2012 (CN) ..... 2012 1 0013762

(51) Int. Cl.
*E05C 3/04* (2006.01)
*B65D 19/06* (2006.01)
(Continued)

(52) U.S. Cl.
CPC ..... *E05C 3/004* (2013.01); *B65D 19/06* (2013.01); *B65D 19/38* (2013.01); *E05B 63/12* (2013.01);
(Continued)

(58) Field of Classification Search
CPC ..... E05C 3/004; E05C 3/047; B65D 19/06; B65D 19/38; B65D 2519/00333;
(Continued)

(56) References Cited

U.S. PATENT DOCUMENTS 777,135 A * 12/1904 Parsons ..... E05B 65/0864 292/205
798,583 A * 8/1905 Harris ..... E05B 65/0864 292/205
(Continued)

FOREIGN PATENT DOCUMENTS

CN 2828259 Y 10/2006
CN 101063388 A 10/2007
CN 202080506 U 12/2011

*Primary Examiner* — Lloyd Gall
(74) *Attorney, Agent, or Firm* — Stephen T. Olson; Harness, Dickey & Pierce, P.L.C.

(57) ABSTRACT

A locket comprises a connection pin, a lock bracket and a lock rod. A first end of the connection pin is fixed to a first connection. A notch is provided on a sidewall of a second end of the connection pin. The lock bracket is fixed to a second connection. The lock rod is rotatable within the lock bracket between an open position and a closed position. A groove is provided on a sidewall of a first end of the lock rod. The groove of the lock rod accommodates the second end of the connection pin passing through the second connection when the lock rod is open, such that the connection pin is moveable in an axial direction. The first end of the lock rod is accommodated within the notch of the connection pin when the lock rod is closed to prevent the connection pin from moving axially.

20 Claims, 10 Drawing Sheets

(51) Int. Cl.

| | |
|---|---|
| ***E05C 3/00*** | (2006.01) |
| ***E05B 63/12*** | (2006.01) |
| ***B65D 19/38*** | (2006.01) |
| *E05B 67/38* | (2006.01) |

(52) U.S. Cl.
CPC .... *E05C 3/047* (2013.01); *B65D 2519/00333* (2013.01); *B65D 2519/00502* (2013.01); *B65D 2519/00611* (2013.01); *B65D 2519/00641* (2013.01); *E05B 67/383* (2013.01); *Y10T 292/1043* (2015.04)

(58) Field of Classification Search
CPC ..... B65D 2519/00611; B65D 2519/00641; B65D 2519/00502; B65D 11/18; B65D 11/1866; B65D 11/1873; E05B 63/12; E05B 67/383; Y10T 292/1043
USPC ..... 70/54–56, 135–137; 292/205, 304; 109/79; 206/386, 600; 220/7, 4.28, 4.32; 403/321, 322.4, 323, 324, 350, 378, 403/379.5, 383; 411/349, 549–553
See application file for complete search history.

(56) References Cited

U.S. PATENT DOCUMENTS 834,810 A * 10/1906 Hulbert ..... E05B 85/24 292/198
1,262,809 A * 4/1918 Kolody ..... E05B 65/0864 292/205
1,326,554 A * 12/1919 Watson ..... E05C 3/12 292/205
1,887,210 A * 11/1932 Miller ..... E05C 3/047 292/205
3,799,593 A * 3/1974 Dielman ..... E05B 15/02 292/145
4,190,379 A 2/1980 Toro Sosa et al.
4,437,692 A * 3/1984 Halopoff ..... E05B 67/38 292/57
4,690,441 A * 9/1987 Fazzolari ..... E05C 1/04 292/57
4,911,486 A * 3/1990 Anderson ..... E05B 67/38 292/148
5,107,570 A * 4/1992 Feith ..... E05F 7/005 16/261
5,284,399 A * 2/1994 Brustle ..... A47B 88/00 403/199
5,690,445 A * 11/1997 Wu ..... B23B 31/103 403/13
5,938,250 A * 8/1999 Onken ..... B65F 1/1615 220/318
6,116,663 A * 9/2000 Robert ..... A61G 17/02 27/DIG. 1
6,152,499 A * 11/2000 Robert ..... A61G 17/02 27/DIG. 1
6,877,628 B2 * 4/2005 Nesting ..... B65D 7/30 206/600
7,097,218 B2 * 8/2006 Lu ..... E05C 3/048 292/130
7,789,601 B2 * 9/2010 Prince ..... A61C 13/0022 269/287
2009/0014445 A1 1/2009 Hay et al.

* cited by examiner

LOCKSET AND REMOVABLE-TYPE PALLET BOX USING LOCKSET

CROSS-REFERENCE TO RELATED APPLICATIONS

This application is a U.S. National Stage Application of International Application No. PCT/CN2012/080908 filed on Sep. 3, 2012, and published in Chinese as WO 2013/107183 A1 on Jul. 25, 2013. This application claims priority to Chinese Application No. 201210013762.6 filed on Jan. 17, 2012. The entire disclosures of the above applications are incorporated herein by reference.

FIELD OF INVENTION

The present invention relates generally to the mechanics field, in particular, to a lockset and a detachable pallet container using the lockset.

BACKGROUND

With the development of the logistics industry, pallet containers have been widely applied in the container transportation area due to their detachable and collapsible features. FIG. 1A illustrates a schematic view of a detachable pallet container that is commonly used at present. As show in FIG. 1A, the detachable pallet container 100 comprises a base 110, a pair of sidewalls 120 and a pair of end walls 130. The pair of sidewalls 120 is detachably arranged at one pair of opposite edges of the base 110, while the pair of end walls 130 is detachably arranged at the other pair of opposite edges of the base 110. After assemblage, adjacent sidewalls 120 and end walls 130 are tightly connected by a lockset 140 or by other means to form a space for cargo storage and transportation, and in the case of empty container, they can be detached and collapsed onto the base for the convenience of warehouse storage and centralized transportation.

FIG. 1B is an enlarged view of the lockset part in FIG. 1A. As shown in FIG. 1B, the lockset comprises a lock bracket 141, a lock rod 142, a hook part 143 and a handle 144. The lock bracket 141 is arranged on the side wall 120, and the lock rod 142 is movably and rotatably provided within the lock bracket 141. On one end of the lock rod 142 for connecting to the end wall 130 is arranged the hook part 143 such that the hook part 143 is perpendicularly connected to the lock rod 142. On the lock rod 142 is also disposed a handle 144 for driving the lock rod 143 to move along its extending direction and to rotate circumferentially. In addition, on the end wall 130 is arranged an oblong thorough-hole 131 matching in shape with the hook part 143. After assembly, the handle 144 is firstly lifted until it is perpendicular to the sidewall 120, then moved so as to enable the hook part 143 to pass through the oblong through-hole 131 on the end wall 130, and then rotated by 90° downwards to enable the hook part 143 to hook onto the side edge of the oblong through-hole 131, hence connecting the end wall 130 and the sidewall 120.

Not withstanding the simple structure of the abovementioned lockset, this locket still has the following defects to overcome for the purpose of improvement: the lockset has a relatively large size, which has to consume a great deal of material; limited by the thickness of the side wall 120, the size of the hook part 143 and the diameter of the lock rod 142 are both relatively small, thus resulting in relatively poor rigidity and being liable to distort; the lock bracket 141 adopts a cantilever structure to support the lock rod 142, and consequently, the lock bracket 141 is liable to distort under the tension from the lock rod 142; after the hook part 143 hooks onto the side edge of the oblong through-hole 131 to connect the end wall 130 and the sidewall 120, there exists activity space along the length of the oblong through-hole 131, and when there is only one pair of end walls 130 or one pair of sidewalls 120 fixed to the base plate 110, the walls not fixed thereto will move up and down relative to the fixed walls, thus impairing the stacking stability of the detachable pallet container, while the play of end walls or sidewalls in the process of transportation will affect the cargo contained therein; in addition, in the closing of locksets, only one lockset can be operated at a time, and therefore, the efficiency is very low.

Therefore, a lockset and a detachable pallet container using this locket are required to solve the abovementioned problems.

SUMMARY OF THE INVENTION

A series of concepts in simplified forms will be introduced to the Summary of the Invention part, and will be further explained in detail in the part of Detailed Description. The Summary of the Invention is not intended for trying defining key features or essential technical features of the technical solutions claimed for protection, and neither is it intended for trying defining the scope of protection of the technical solutions claimed for protection.

For the purpose of solving the abovementioned problems, the present invention discloses a lockset. The lockset comprises: a connection pin, wherein a first end of the connection pin is for being fixed to a first connection, and a notch is provided on a sidewall of a second end of the connection pin; a lock bracket for being fixed to a second connection; and a lock rod, which is rotatably provided within the lock bracket such that the lock rod has an open position and a closed position, wherein a groove is provided on a sidewall of a first end of the lock rod. In an assembled state, the groove of the first end of the lock rod can accommodate the second end of the connection pin passing through the second connection when the lock rod is at the open position, such that the connection pin is moveable in an axial direction; and the first end of the lock rod is accommodated within the notch of the second end of the connection pin passing through the second connection when the lock rod is at the closed position so as to prevent the connection pin from moving axially.

Preferably, a handle is disposed on a second end of the lock rod for driving the lock rod to rotate.

Preferably, the lock bracket has a locking component provided thereon to lock the handle when the lock rod rotates to the closed position.

Preferably, the lock rod is provided within the lock bracket with the lock rod immovable in both axial and radial directions.

Preferably, the lock bracket is provided with an oblong through-hole encompassing the lock rod, and a handle is disposed at a second end of the lock rod, wherein a first end of the handle passes through the oblong through-hole to connect to the lock rod, with the size of the first end of the handle matching with the width of the oblong through-hole so as to restrain the lock rod from moving in its axial direction, and wherein the first end of the handle is moveable in the oblong through-hole along its length direction.

Preferably, the groove is located in such a position as to accommodate the second end of the connection pin when the first end of the handle moves to one end of the oblong through-hole.

Preferably, an accommodating hole is arranged on the lock rod at a position connected to the first end of the handle, and the first end of the handle is accommodated within the accommodating hole in which the first end of the handle is connected to the lock rod.

Preferably, the handle is U-shaped, and a second end of the handle is connected to the lock rod outside the lock bracket.

Preferably, an opening direction of the groove is perpendicular to a plane on which the handle is located.

Preferably, the lock bracket is provided with an arc groove extending along the axial direction of the lock rod, and the lock rod is accommodated within the arc groove and matches with the arc groove so as to cooperate with the second connection in restraining the lock rod from moving in the radial direction.

Preferably, the connection pin is cylindrical, and the groove is semicircular for matching with the connection pin.

Preferably, the lock rod is cylindrical, and the notch is semicircular for matching with the lock rod.

The present invention also provides a detachable pallet container. The container comprises a base, a pair of sidewalls detachably connected to one pair of opposite edges of the base, and a pair of end walls detachably connected to the other pair of opposite edges. The detachable pallet container also comprises a lockset as mentioned above, wherein the connection pin is perpendicularly fixed to an end face of the sidewall, the lock bracket is fixed on an exterior side of the end wall to which the lock rod is parallel, and a through-hole for the connection pin passing therethrough is arranged on the end wall at a position corresponding to the connection pin, wherein in the assembled state, the second end of the connection pin passes through the through-hole on the end wall to cooperate with the lock rod, so as to enable the side wall and the end wall to interlock with each other.

Preferably, an opening direction of the notch is upward.

Preferably, a press plate is disposed on the end wall over the through-hole, and the space formed between the notch and the press plate fits with the lock rod after the connection pin passes through the through-hole.

The lockset according to the present invention has a relatively small size, which therefore, compared to the prior art, enables the connection pin and the lock rod to have a relatively large diameter in limited space, thus improving connection strength. And there is no play between connections connected by this locket, resulting in reliable connection. In addition, the lockset also has the advantages including simple structure, less material consumption, convenience of processing, easy operation, low cost, etc.

BRIEF DESCRIPTION OF THE DRAWINGS

The accompanying drawings are incorporated herein as a part of the specification to provide further understanding of the present invention. The drawings illustrate embodiments of the present invention and, together with the description, serve to explain the principles of the present invention. In the drawings.

DETAILED DESCRIPTION

Great specific details will be provided in the following description to facilitate more thorough understanding of the present invention. However, it would be apparent to those skilled in the art that the present invention is implementable without requiring one or more of these details. In other examples, some technical features well-known in the art will not be described, in order to avoid causing confusion with the present invention.

For the purpose of thorough understanding of the present invention, detailed structures will be provided in the following description. Evidently, implementation of the present invention is not limited to particular details familiar to those skilled in the art. Detailed descriptions of preferred embodiments of the present invention will be provided as follows. However, besides these detailed descriptions, there may be other embodiments of the present invention.

Figure 1A:
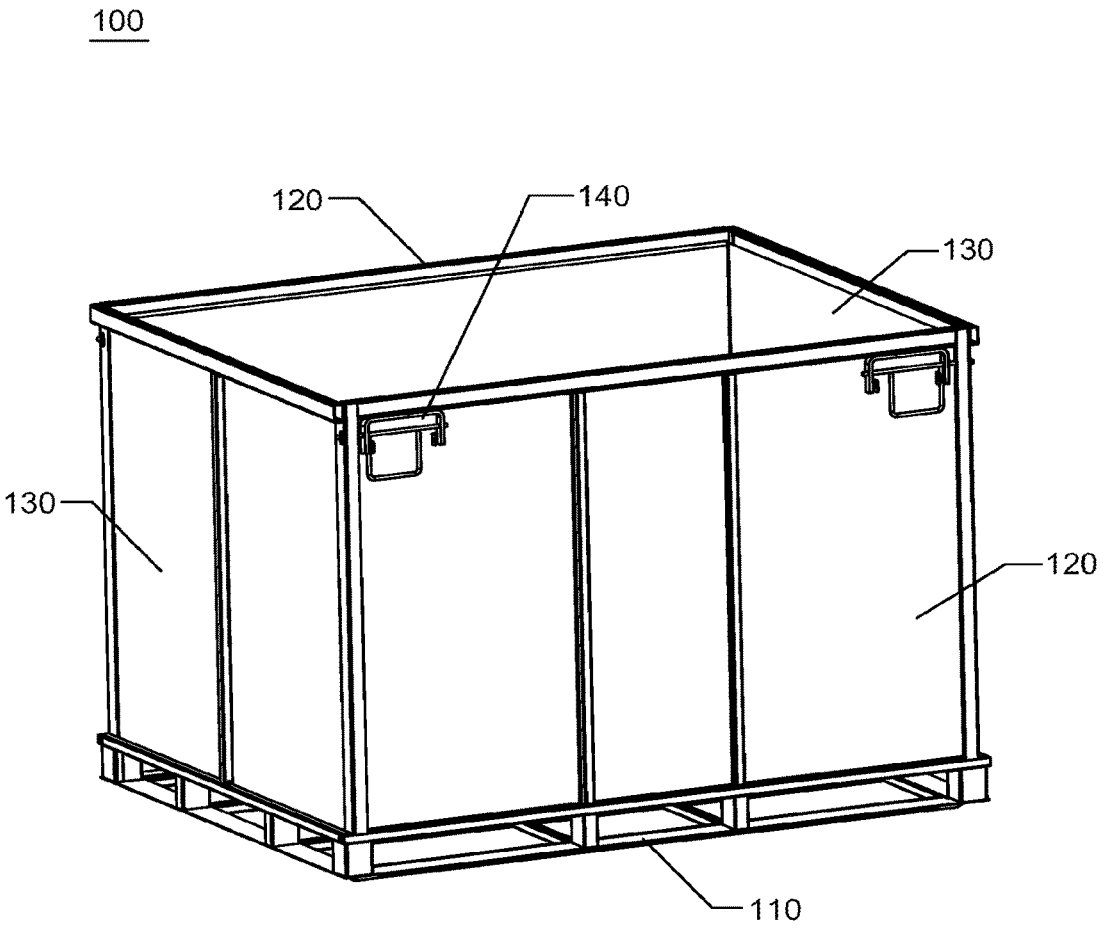
Fig.1A PRIOR ART
FIG. 1A illustrates a schematic view of a detachable pallet container commonly used at present.
Figure 1B:
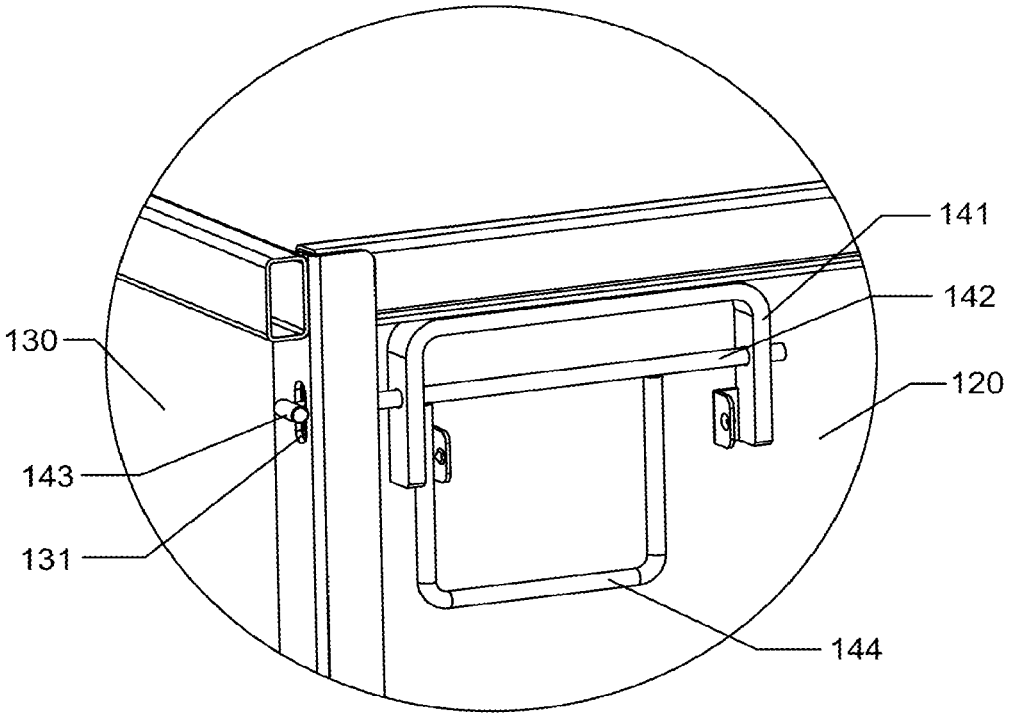
Fig.1B PRIOR ART
FIG. 1B illustrates an enlarged view of the lockset part in FIG. 1A.
Figure 2:
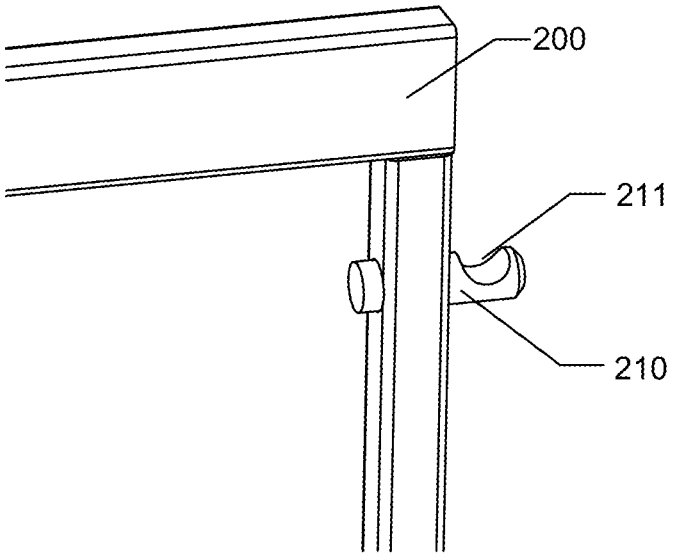
FIG. 2 illustrates a schematic view of a connection pin connecting with a first member to be connected according to an embodiment of the present invention.
Figure 3A:
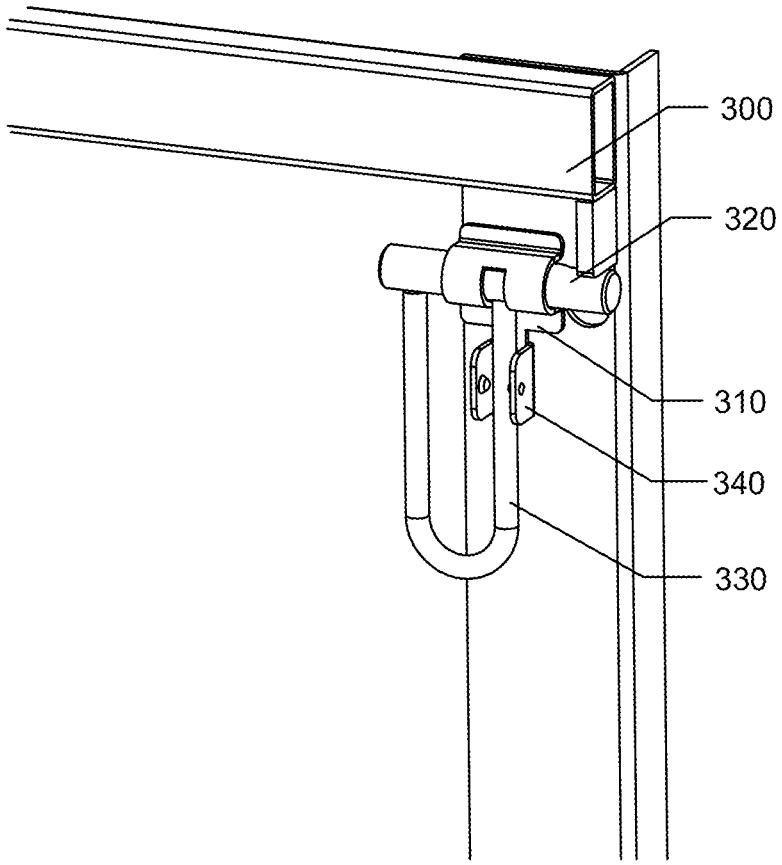
FIGS. 3A and 3B illustrate schematic views of a lock bracket and a lock rod connecting with a second connection according to an embodiment of the present invention.
Figure 3B:
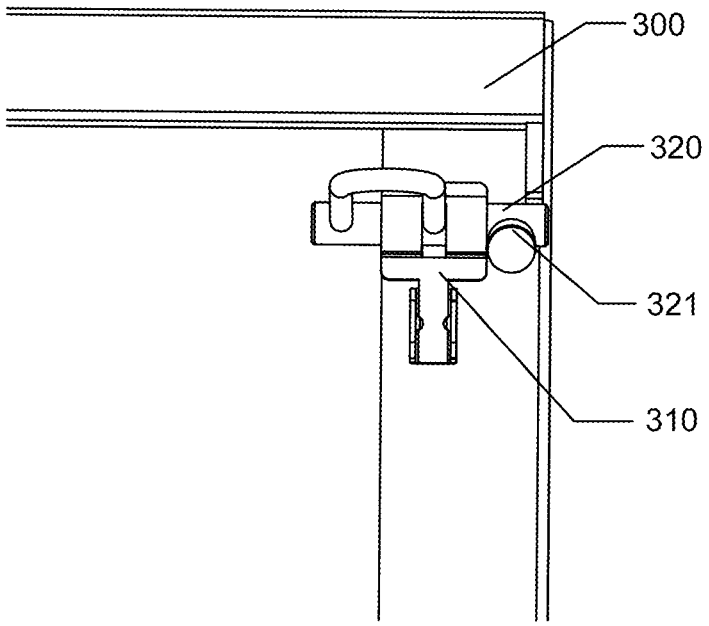

The present invention provides a lockset, comprising a connection pin, a lock bracket and a lock rod. FIG. 2 illustrates a schematic view of a connection pin 210 connecting with a first connection according to an embodiment of the present invention, and FIGS. 3A-3B illustrate respective schematic views of a lock bracket 310 and a lock rod 320 connecting with a second connection according to an embodiment of the present invention. By referring to FIG. 2 and FIGS. 3A-3B, detailed descriptions shall be made in the following of the various parts of the lockset according to the present invention.

As shown in FIG. 2, a first end of the connection pin 210 is for being fixed to a first connection 200. The connection pin 210 can be in circular column, square column or any other shape, as long as its first end can be fixed to the first connection 200 and its second end can pass through the second connection (not shown). In order to prevent the second end from scratching the operator or other parts, the end portion of the second end may be chamfered. The first end of the connection pin 210 can be fixed to the first connection 200 by means of welding, screw-jointing or riveting, or the connection pin 210 may also be integrated with the first connection 200. A notch 211 is provided on the side wall of the second end of the connection pin 210, and used for accommodating one end of the lock rod (which will be described later). The notch 211 can be an arc groove, a rectangular groove or a groove in any other shape, and the opening of the notch 211 can be upwards, downwards, forwards, backwards or towards any other direction. The opening direction of the notch 211 needs to be disposed according to the location relation between the first connection 200 and the second connection as well as the location relation between the connection pin 210 and the lock rod. The notch 211 provided on the connection pin 210 is aimed at accommodating the lock rod and restraining the connection pin 210 from moving axially by the lock rod when the lock rod is at a closed position. Therefore, based on this principle, those skilled in the art would be able to dispose the opening direction of the notch 211 according to the location relation between the first connection 200 and the second connection as well as the location relation between the connection pin 210 and the lock rod.

As shown in FIGS. 3A-3B, a lock bracket 310 is for being fixed to the second connection 300. The lock bracket 310 can be fixed to the second connection 300 by means of welding, screw-jointing or riveting, or may also be integrated with the second connection 300. A lock rod 320 is rotatably provided within the lock bracket 310 such that the lock rod 320 has an open position and a closed position. The lock bracket 310 is used for supporting the lock rod 320 and allowing the lock rod 320 to rotate within the lock bracket 310. The lock bracket 310 may have any structure capable of fulfilling this function. The structure of the lock bracket 310 according to a preferred embodiment of the present invention will be described in detail later in this disclosure. When the lock rod 320 rotates to the open position, the connection pin and the lock rod 320 disconnect from each other; when the lock rod 320 rotates to the closed position, the connection pin and the lock rod 320 will be locked relative to each other. A groove 321 is provided on the sidewall of the first end of the lock rod 320 (as shown in FIG. 3B). The groove 321 can be an arc groove, a rectangular groove or a groove in any other shape, and the opening direction of the groove 321 can be upwards, downwards, forwards, backwards or towards other direction. Similarly, the opening direction of the groove 321 needs to be disposed according to the location relation between the first connection and the second connection 300 as well as the location relation between the connection pin and the lock rod 320. The groove 321 provided on the lock rod 320 is aimed to accommodate the connection pin passing through the second connection 300 so as to allow the connection pin to move axially, when the lock rod 320 is at an open position. Therefore, based on this principle, those skilled in the art would be able to dispose the opening direction of the groove 321 according to the location relation between the first connection and the second connection 300 as well as the location relation between the connection pin and the lock rod 320.

Figure 4A:
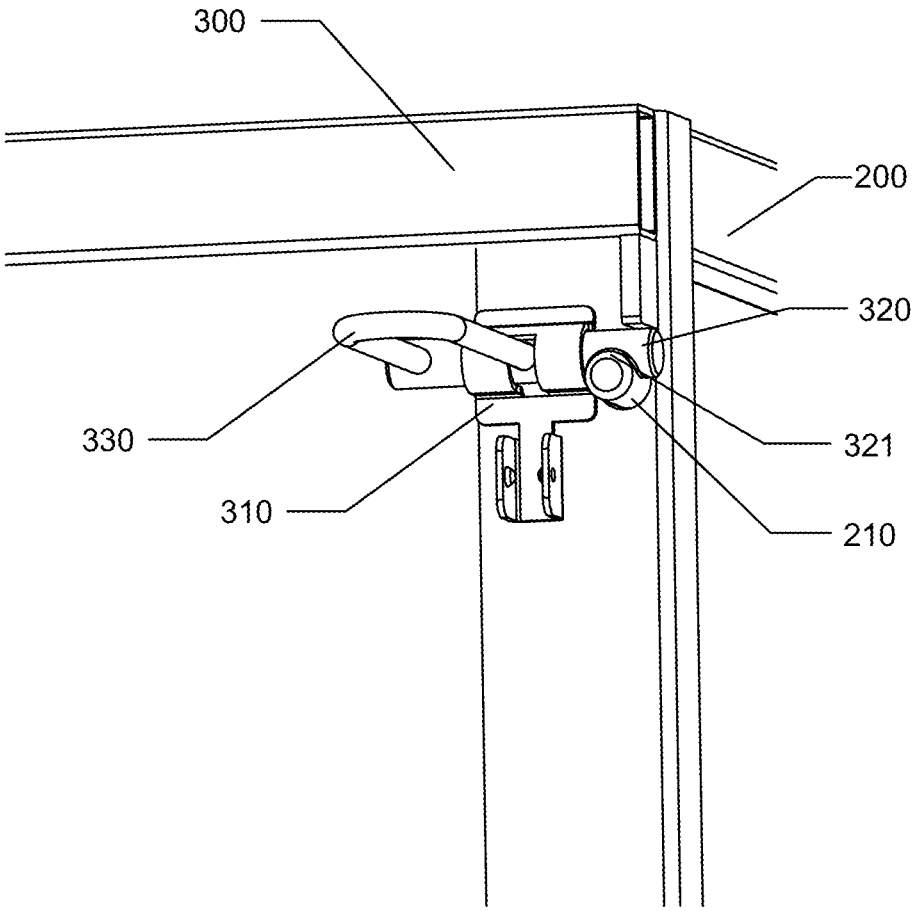
FIGS. 4A and 4B illustrate schematic views of a lockset in an open and a closed states, respectively according to an embodiment of the present invention.
Figure 4B:
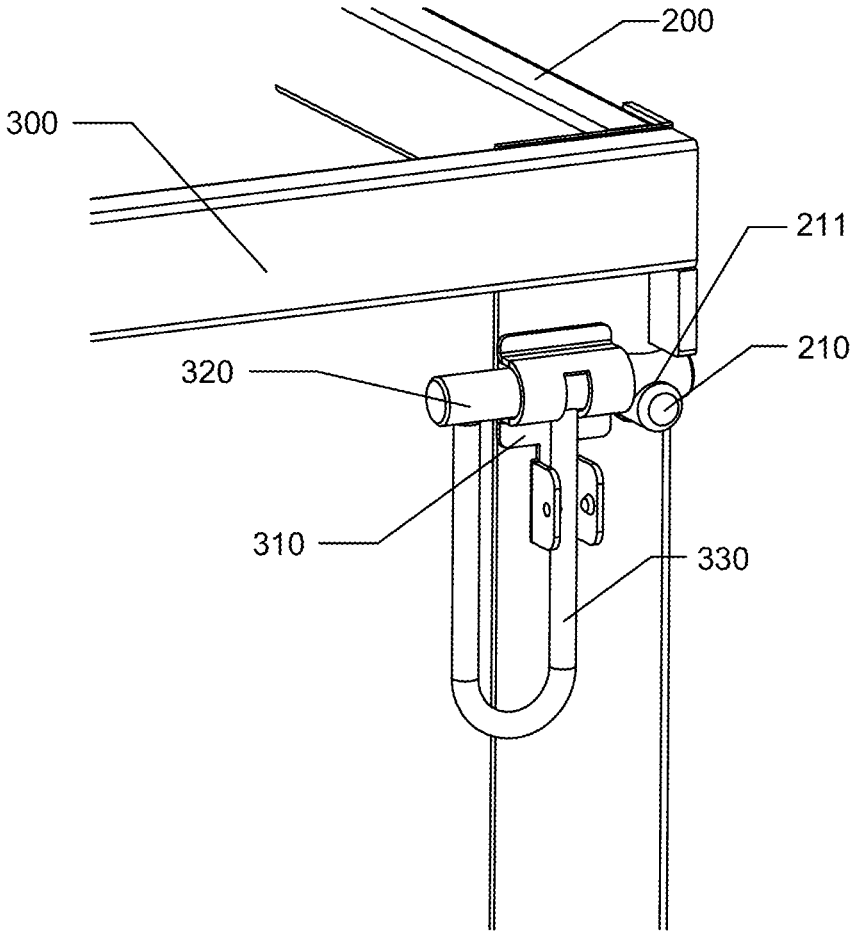

In the assembled state (that is, the connection pin 210 is fitted onto the first connection 200 and the lock 310 and the lock rod 320 are fitted onto the second connection 300), the groove 321 at the first end of the lock rod 320 can accommodate the second end of the connection pin 210 passing through the second connection 300 so that the connection pin 210 is movable axially, when the lock rod 320 is at the open position (as shown in FIG. 4A). Since the connection pin 210 is movable in its axial direction, the connection pin 210 can disconnect from the lock rod 320. In the assembled state, the first end of the lock rod 320 is accommodated within the notch 211 at the second end of the connection pin 210 passing through the second connection 300 so as to prevent the connection pin 210 from moving axially, when the lock rod 320 is at the closed position (as shown in FIG. 4B). The radial movement of the connection pin 210 is restricted by the second connection 300, and the connection pin 210 can be restrained from moving axially by accommodating the first end of the lock rod 320 within the notch 211, so as to lock the lock rod 320 and the connection pin 210 together.

As an example, the connection pin 210 is cylindrical, and the groove 321 on the lock rod 320 is semicircular. The groove 321 matches with the connection pin 210, such that the connection pin 210 fits and locks the groove 321 as well as possible in the assembled state, so as to reduce the space occupied by the lockset, and to improve the lockset strength on the premise of using the same size of lock rod 320. As an example, the lock rod 320 is cylindrical, and the notch 211 is semicircular. The notch 211 matches with the lock rod 320, such that in the assembled state, the lock rod 320 can be locked by the notch 211 when the lock rod 320 is at the closed position, so as to improve the locking stability and reduce the space occupied by the lockset as well.

Preferably, as shown in FIG. 3A, a handle 330 is disposed at the second end of the lock rod 320 to drive the lock rod 320 to rotate, for the convenience of operations of opening and locking the lockset. The handle 330 can be in any shape, such as rod-like, U-shaped, T-shaped, L-shaped, etc. as oblong as it is convenient to be held by hand. Furthermore, the lock bracket 310 is also provided with a locking component 340. The locking component 340 can lock the handle 330 when the lock rod 320 rotates to the closed position, so as to prevent unexpected opening of the lock set. The locking component 340 can be configured as baffles at both sides of the handle 330. Also, protruding members may be arranged on the opposite side surfaces of the baffles. In this way, the handle 330 can be locked by pushing the handle 330 into the space defined by the protruding members and the lock bracket 310. Of course, the locking component 340 can also have other structure, as long as it can lock the handle 330 when the lock rod 320 rotates to the closed position.

Figure 5:
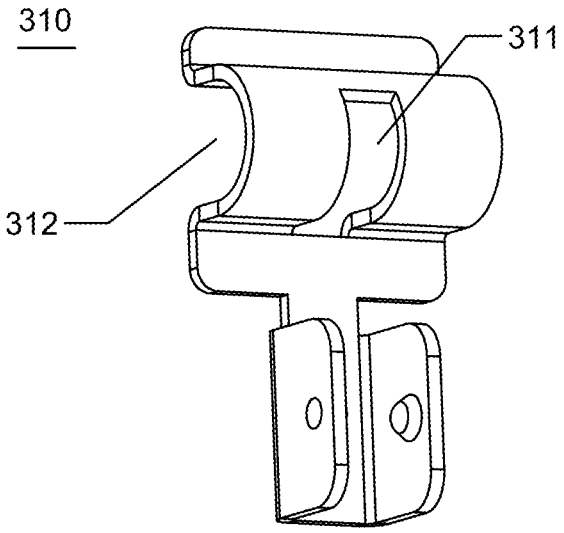
FIG. 5 illustrates a schematic view of a lock bracket according to an embodiment of the present invention.

According to a preferred embodiment of the present invention, the lock rod 320 is provided within the lock bracket 310 and the lock rod 320 is immovable axially and radially, so that the lock rod 320 is prevented from moving in axial and radial directions and only able to rotate. As an example, by referring to FIG. 5 and FIG. 4B, the lock bracket 310 is provided with an oblong through-hole 311 encompassing the lock rod 320. The oblong through-hole 311 in the lock bracket 310 encompasses a portion of the periphery of the lock rod 32. The handle 330 can be arranged at the second end of the lock rod 320 opposite to the first end on which the groove 321 is provided, and the first end of the handle 330 passes through the oblong through-hole 311 to connect to the lock rod 320. In order to prevent the lock rod 320 from moving axially, the size of the first end of the handle 330 matches with the width of the oblong through-hole 311. To enable the handle 330 to drive the lock rod 320 to rotate within the lock bracket 310, the first end of the handle 330 can be movable in the oblong through-hole 311 along the length direction thereof. The reciprocal movement of the first end of the handle 330 in the oblong through-hole 311 can drive the lock rod 320 to rotate between its open and closed positions. As an example, when the first end of the handle 330 moves to the top of the oblong through-hole 311, as shown in FIG. 4A, at which the handle 330 may be considered to be perpendicular to the second connection 300, the lock rod 320 is at the open position; when the first end of the handle 330 moves to the bottom of the oblong through-hole 311, as shown in FIG. 4B, at which the handle 330 may be considered to be parallel to the second connection 300, the lock rod 320 is at the closed position. It can be understood such that the lock rod 320 can be locked by the connection pin 210 as soon as the first end of the handle 330 leaves the top of the oblong through-hole 311. However, the closed position shown in FIG. 4B is one of the ideal closed positions. As an example, by referring to FIG. 5 and FIG. 4B, the lock bracket 310 is provided with an arc groove 312 running along the axis of the lock rod 320, and the lock rod 320 is accommodated within and matches with the arc groove 312, so as to cooperate with the second connection 300 to restrain the lock rod 312 from moving radially. Herein, the lock rod 320 is supported by the lock bracket 310 by virtue of the arc groove 312 arranged thereupon, and the lock rod 320 is restricted within the space between the arc groove 312 and the second connection 300, so as to prevent the lock rod 320 from moving in its radial direction. Of course, the lock bracket 310 can also employ other means to support the lock rod 320, as long as the lock rod 320 can be arranged therein such that the lock rod 320 is only capable of rotating.

For the convenience of operation, preferably, when the first end of the handle 330 moves to one end of the oblong through-hole 311, the groove 321 is located at such a position as to accommodate the second end of the connection pin 210, as shown in FIG. 4A. In this way, in locking the connection pin 210 and the lock rod 320, merely by pushing the handle 330 to this end, the connection pin 210 will be enabled to pass through the second connection 300 and to be accommodated within the groove 321, and then by just rotating the handle 330, the locking operation can be completed.

Figure 6:
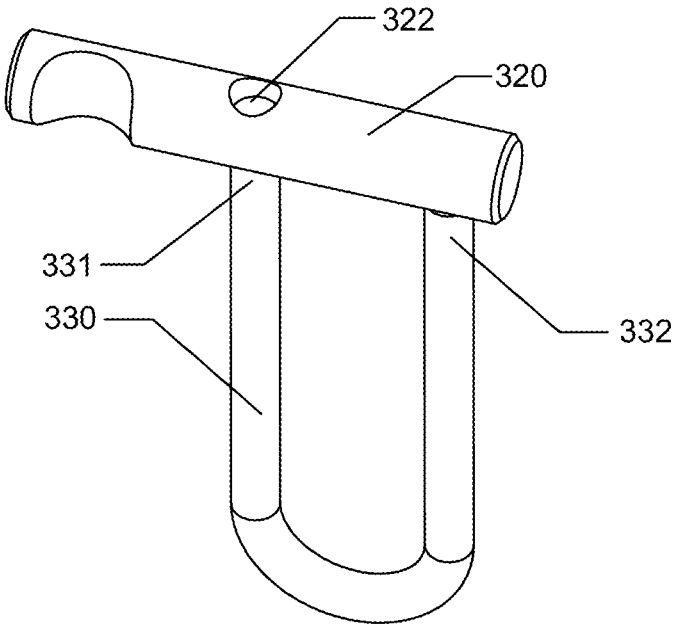
FIG. 6 illustrates a schematic view of a lock rod provided with a handle according to an embodiment of the present invention.

The lock rod 320 and the handle 330 can be connected by means of welding or by other means. Preferably, as shown in FIG. 6, an accommodating hole 322 may be arranged on the lock rod 320 at the position connected to the first end 331 of the handle 330. The first end 331 of the handle 330 can be inserted into the accommodating hole 322 and connected to the lock rod 320 in the accommodating hole 322. The first end 331 of the handle 330 can be adhered or welded to the lock rod 320 within the accommodating hole 322. This connecting means can prevent the weld bead formed by directly welding the handle 330 onto the outside of the lock rod 320 from interfering with the oblong through-hole 311 and the arc groove 312 which is on the lock bracket 310 for accommodating the lock rod, so as to ensure tight fitting between the lock rod 320 and the lock bracket 310, improving connection stability. In order to enhance comfort in using the handle 330, preferably, the handle 330 is U-shaped, and the second end 332 of the handle 330 is connected to the lock rod 320 outside the lock bracket 310, as shown in FIG. 6 and FIGS. 4A-4B.

According to a preferred embodiment of the present invention, when the handle 330 is U-shaped, the opening direction of the groove 321 is perpendicular to the plane on which the handle 330 is located, as shown in FIG. 6 and FIGS. 4A-4B. In this way, when the handle 330 is perpendicular to the second connection 300, the lock rod 320 is at the open position, which allows the connection pin 210 to move in its axial direction; and when the handle 330 is parallel to the second connection 300, the lock rod 320 is at the closed position, which prevents the connection pin 210 from moving in its axial direction. Since the first connection 200 and the second connection 300 need to be in a connected state for a relatively long time during their usage, the handle 330 is able to abut against the second connection 300 when the lock rod 320 is at the closed position, so as to reduce the space occupied by the locket lockset in use and to prevent the lockset in use from protruding out of the connections to be crashed.

Figure 7A:
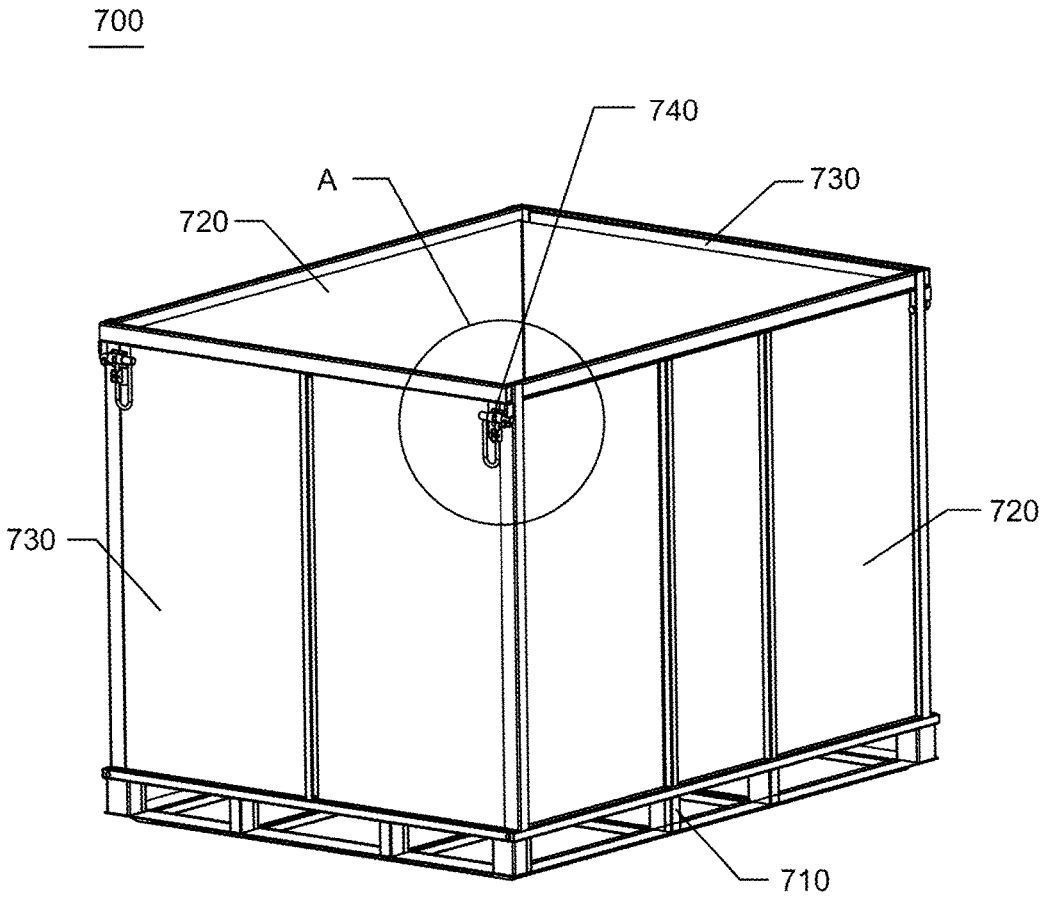
FIG. 7A illustrates a schematic view of a detachable pallet container according to an embodiment of the present invention.
Figure 7B:
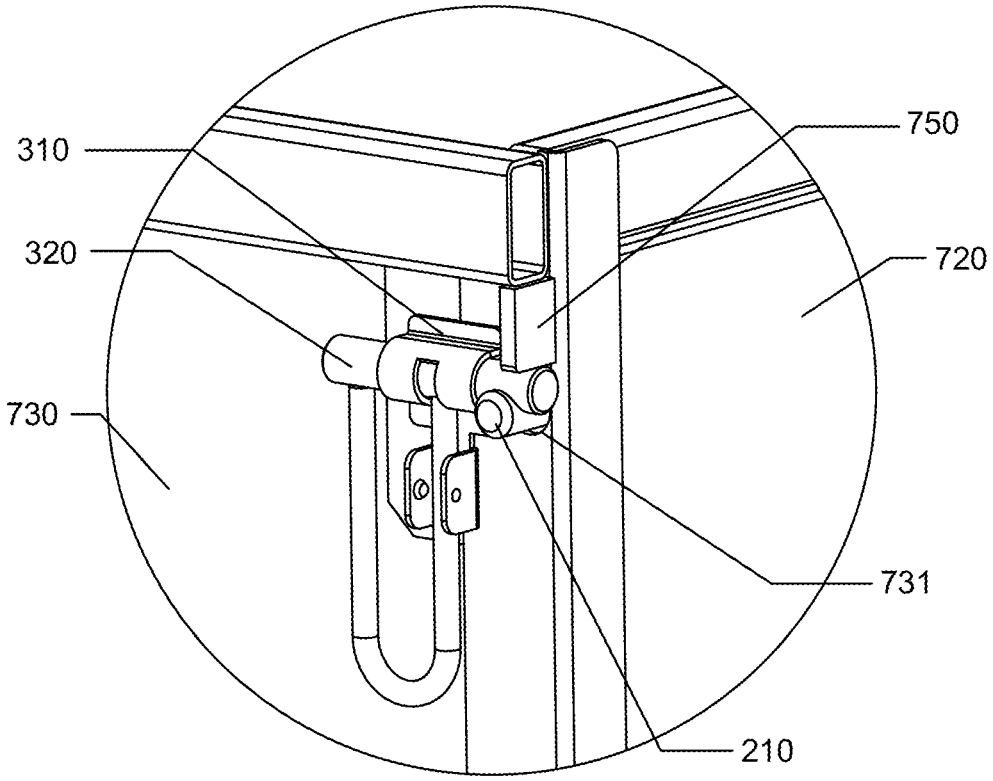
FIG. 7B illustrates an enlarged view of the area A in FIG. 7A.

The present invention also provides a detachable pallet container, as shown in FIG. 7A. The detachable pallet container 700 comprises a base 710, a pair of sidewalls 720 and a pair of end walls 730. The pair of sidewalls 720 is detachably connected to one pair of opposite edges of the base 710, and the pair of end walls 730 is detachably connected to the other pair of opposite edges of the base 710. The detachable pallet container 700 also comprises a lockset as described above. Detailed description has been given to the shape and structure of the lockset, and therefore, no more explanation shall be provided herein. As shown in FIG. 7B, the connection pin 210 of the lockset is perpendicularly fixed to an end face of the sidewall 720, namely the side surface of the sidewall 720 that is in contact with the end wall 730 after assemblage. The lock bracket 310 is fixed to the exterior side of the end wall 730 (for example, fixed to the edge vertical post of the end wall 730), and the lock rod 320 is parallel to the end wall 730. A through-hole 731 for the connection pin 210 passing therethrough is arranged on the end wall 730 at a position corresponding to the connection pin 210. In the assembled state, the second end of the connection pin 210 passes through the through-hole 731 in the end wall 730 to cooperate with lock rod 320, such that the side wall 720 and the end wall 730 can interlock with each other. After assemblage, the sidewall 720 and the end wall 730 that are adjacent to each other are tightly connected by the lockset 740, so as to form space for cargo storage and transportation, and in the case of empty container, they can be detached and collapsed onto the base for the convenience of warehouse storage and centralized transportation.

In assemblage of the detachable pallet container 700, the underbeams of the two end walls 730 and the two sidewalls 720 can be inserted into the edge slots of the base 710, respectively; then, the side walls 720 stands upright to align the connection pin 210 on the sidewall 720 with the through-hole 731 in the end wall 730; and then, the lock rod 320 is rotated until the groove on the lock rod 320 exposes the through-hole 731; and lastly, the end wall 730 is pushed until the connection pin 210 passes through the through-hole 731 and the groove on the lock rod 320, and the lock rod 320 is rotated to make the lockset work.

Preferably, the opening direction of the notch on the side wall of the second end of the connection pin 210 is upward, such that in a closed state, the lock rod 320 can be accommodated within the notch over the connection pin 210. Furthermore, a press plate 750 is provided over the through-hole 731 on the end wall 730, such that when the connection pin 210 has passed through the through-hole 731, the space formed between the notch on the connection pin 210 and the press plate 750 can fit with the lock rod 320. This can prevent the lock rod 320 from moving upwards and leaving the notch of the connection pin 210 when the lockset is under external force.

The lockset according to the present invention has a relatively small size, which therefore, compared to the prior art, enables the connection pin and the lock rod to have a relatively large diameter in limited space, thus improving connection strength. And there is no play between connections connected by this lockset, resulting in reliable connection. In addition, the lockset also has the advantages including simple structure, less material consumption, convenience of processing, easy operation, low cost, etc.

The present invention has been described by virtue of the abovementioned embodiments. However, it should be appreciated that the abovementioned embodiments are exemplary and illustrative, but not intended for limiting the present invention to the embodiments described above. In addition, it is also appreciated for those skilled in the art that more types of variation and modification can be made based on the teachings of the present invention, with these variations and modifications all falling within the scope of protection of the present invention. The protection scope of the present invention is defined by the attached claims and equivalent scope thereof.

What is claimed is:

1. A lockset, comprising:

a connection pin, wherein a first end of the connection pin is for being fixed to a first connection, and a notch is provided on a sidewall of a second end of the connection pin;

a lock bracket for being fixed to a second connection; and a lock rod, which is rotatably provided within the lock bracket such that the lock rod has an open position and a closed position, wherein a groove is provided on a sidewall of a first end of the lock rod, wherein in an assembled state, the groove of the first end of the lock rod can accommodate the second end of the connection pin when the lock rod is at the open position, such that the connection pin is moveable in an axial direction; and the first end of the lock rod is accommodated within the notch of the second end of the connection pin when the lock rod is at the closed position so as to prevent the connection pin from moving axially, and wherein only the lock rod is inserted into the lock bracket and the connection pin is not inserted into the lock bracket.

2. The lockset according to claim 1, wherein a handle is disposed on a second end of the lock rod for driving the lock rod to rotate.

3. The lockset according to claim 2, wherein the lock bracket has a locking component provided thereon to lock the handle when the lock rod rotates to the closed position.

4. The lockset according to claim 1, wherein the lock rod is provided within the lock bracket with the lock rod immovable in both axial and radial directions.

5. The lockset according to claim 4, wherein the lock bracket is provided with an oblong through-hole encompassing the lock rod, and a handle is disposed at a second end of the lock rod, wherein a first end of the handle passes through the oblong through-hole to connect to the lock rod, with the size of the first end of the handle matching with the width of the oblong through-hole so as to restrain the lock rod from moving in its axial direction, and wherein the first end of the handle is moveable in the oblong through-hole along a length direction of the oblong through-hole.

6. The lockset according to claim 5, wherein the groove is located in such a position as to accommodate the second end of the connection pin when the first end of the handle moves to one end of the oblong through-hole.

7. The lockset according to claim 5, wherein an accommodating hole is arranged on the lock rod at a position connected to the first end of the handle, and the first end of the handle is accommodated within the accommodating hole in which the first end of the handle is connected to the lock rod.

8. The lockset according to claim 5, wherein the handle is U-shaped, and a second end of the handle is connected to the lock rod outside the lock bracket.

9. The lockset according to claim 8, wherein an opening direction of the groove is perpendicular to a plane on which the handle is located.

10. The lockset according to claim 4, wherein the lock bracket is provided with an arc groove extending along the axial direction of the lock rod, and the lock rod is accommodated within the arc groove and corresponds in shape with the arc groove so as to cooperate with the second connection in restraining the lock rod from moving in the radial direction.

11. The lockset according to claim 1, wherein the connection pin is cylindrical, and the groove is semicircular for corresponding in shape with the connection pin.

12. The lockset according to claim 1, wherein the lock rod is cylindrical, and the notch is semicircular for corresponding in shape with the lock rod.

13. The lockset according to claim 1, wherein the first end of the lock rod axially extends beyond the lock bracket and cooperates with the connection pin at a location axially beyond the lock bracket.

14. The lockset according to claim 1, wherein the lock bracket includes a portion radially surrounding the lock rod, the portion defining a slot for receiving one arm of a U-shaped handle extending from the lock rod.

15. The lockset according to claim 1, in combination with the first and second connections, the first and second connections being structural members.

16. A detachable pallet container, comprising a base, a pair of sidewalls detachably connected to one pair of opposite edges of the base, and a pair of end walls detachably connected to the other pair of opposite edges, wherein the detachable pallet container also comprises a lockset as claimed in claim 1, wherein the connection pin is perpendicularly fixed to an end face of one of the sidewalls, the lock bracket is fixed on an exterior side of one of the end walls to which the lock rod is parallel, and a through-hole for the connection pin passing therethrough is arranged on an associated end wall at a position corresponding to the connection pin, wherein in the assembled state, the second end of the connection pin passes through the through-hole on the associated end wall to cooperate with the lock rod, so as to enable the associated sidewall and the associated end wall to interlock with each other.

17. The detachable pallet container according to claim 16, wherein an opening direction of the notch is upward.

18. The detachable pallet container according to claim 17, wherein a press plate is disposed on the end wall over the through-hole, and the space formed between the notch and the press plate fits with the lock rod after the connection pin passes through the through-hole.

19. A lockset, comprising:

a connection pin having a first end for fixation to a first structural member and a notch is provided on a sidewall of a second end;

a lock bracket for fixation to a second structural member; and a lock rod rotatably provided within the lock bracket such that the lock rod is rotatable between an open position and a closed position, the lock rod including a groove on a sidewall of a first end thereof for accommodating the second end of the connection pin when the lock rod is rotated to the open position, such that the connection pin is moveable in an axial direction;

the notch of the second end of the connection pin accommodating the first end of the lock rod when the lock rod is rotated to the closed position and thereby preventing the connection pin from moving axially, and wherein the lock rod axially extends through the lock bracket and the connection pin is axially beyond the lock bracket.

20. The lockset of claim 19, wherein the lock bracket includes a portion radially surrounding the lock rod, the portion defining a slot for receiving one arm of a U-shaped handle extending from the lock rod.

* * * * *